US005987915A

United States Patent [19]

Incorvia et al.

[11] Patent Number: 5,987,915

[45] Date of Patent: Nov. 23, 1999

[54] SADDLE-TYPE ADSORBENT UNIT

[75] Inventors: Samuel A. Incorvia, N. Tonawanda; Patrick M. Murray, Lockport; Paul A. Riemenschneider, Williamsville, all of N.Y.

[73] Assignee: Multisorb Technologies, Inc., Buffalo, N.Y.

[21] Appl. No.: 09/084,536

[22] Filed: May 26, 1998

[51] Int. Cl.[6] ..... B01D 53/02; F25B 43/00

[52] U.S. Cl. ..... 62/474; 62/503; 55/503; 96/147

[58] Field of Search ..... 62/474, 475, 503; 96/147; 55/503

[56] References Cited

U.S. PATENT DOCUMENTS

| | | | |
|---|---|---|---|
| 4,116,649 | 9/1978 | Cullen et al. | 55/387 |
| 4,272,264 | 6/1981 | Cullen et al. | 55/387 |
| 4,401,447 | 8/1983 | Huber | 55/387 |
| 4,405,347 | 9/1983 | Cullen et al. | 55/387 |
| 4,464,261 | 8/1984 | Cullen et al. | 210/282 |
| 4,619,673 | 10/1986 | Cullen et al. | 55/387 |
| 4,911,739 | 3/1990 | Cullen et al. | 55/387 |
| 4,994,185 | 2/1991 | Cullen et al. | 210/282 |
| 5,177,982 | 1/1993 | Plemens | 62/503 |
| 5,636,525 | 6/1997 | Riemenschneider | 62/474 |

*Primary Examiner*—William Doerrler
*Attorney, Agent, or Firm*—Joseph P. Gastel

[57] ABSTRACT

An adsorbent unit consisting of first and second porous fabric containers having adsorbent therein, a connecting member connecting end portions of the containers to each other, and tabs connecting side edge portions of the containers to each other with the containers oriented in side-by-side relationship. The foregoing adsorbent unit is mounted on the U-shaped pipe of a refrigerant accumulator with the connecting member adjacent the return bend of the accumulator and the tabs adjacent the pipe portions of the U-shaped pipe. The adsorbent unit can be shrunk relative to the U-shaped pipe after it has been installed thereon.

37 Claims, 4 Drawing Sheets

Fig. 1.
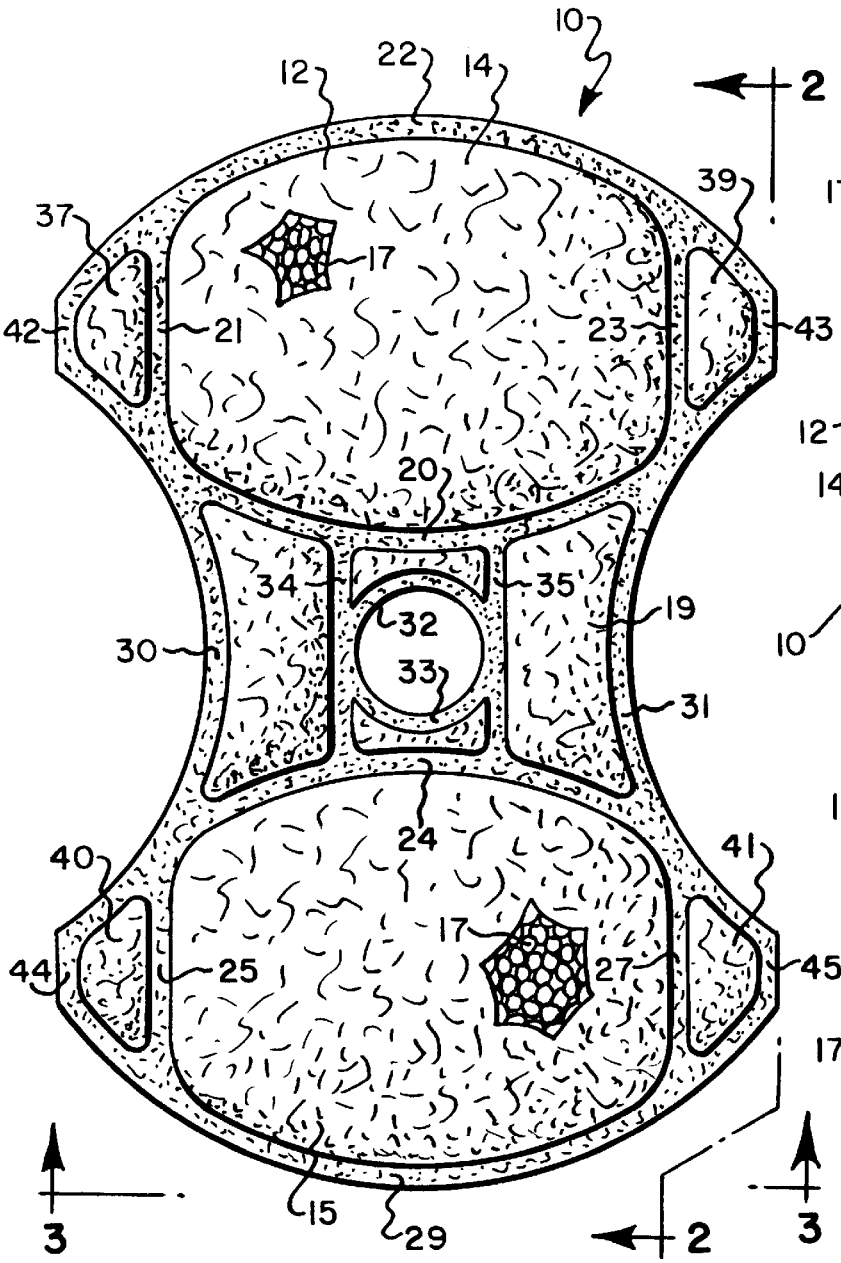
Fig. 2.
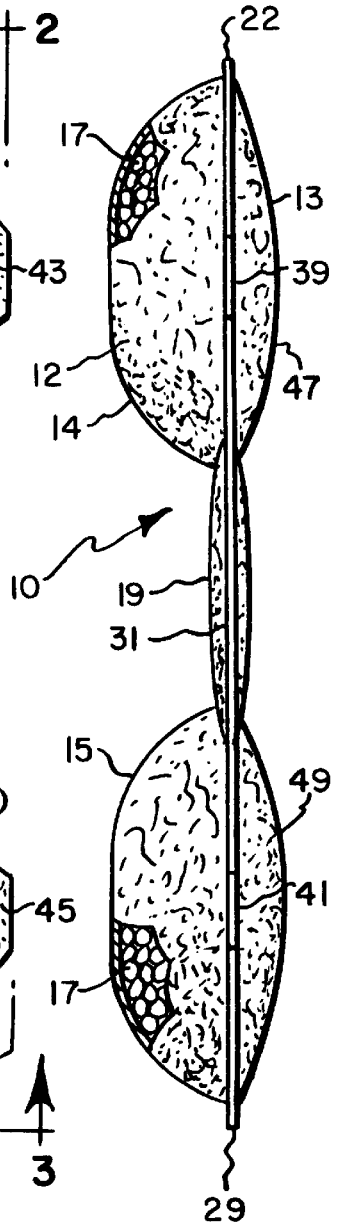
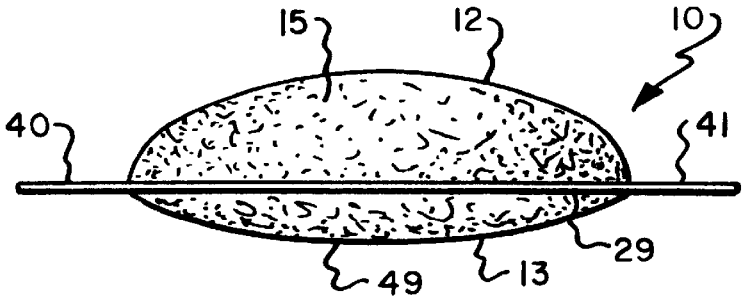
Fig. 3.

Fig. 4.
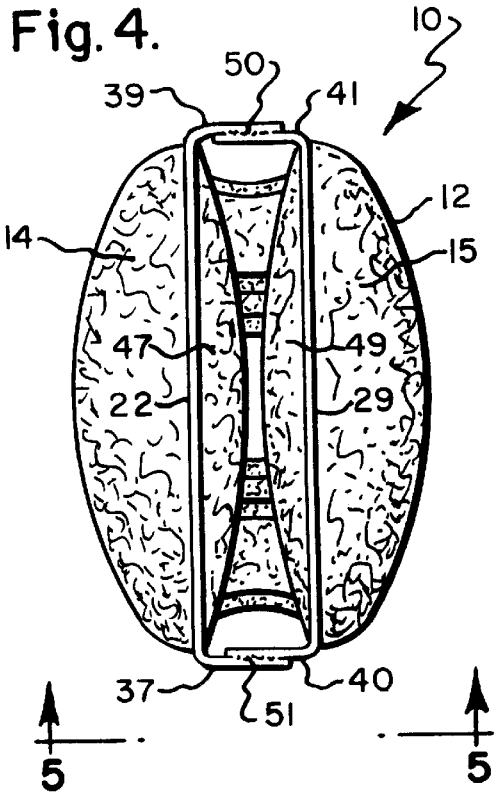
Fig. 6.
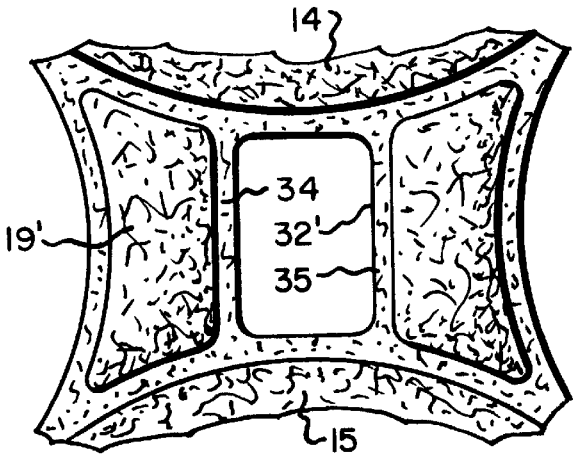
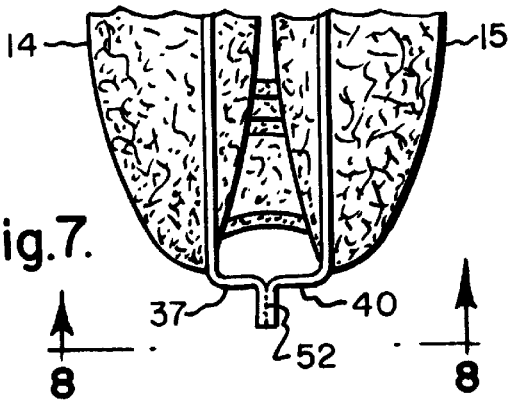
Fig.7.
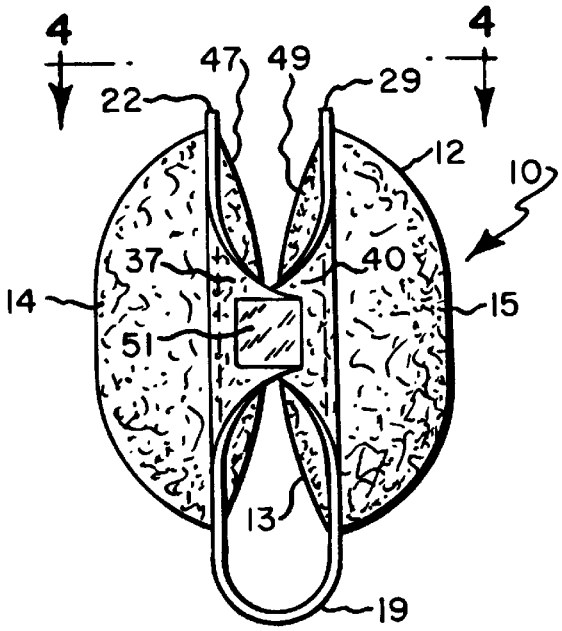
Fig. 5.
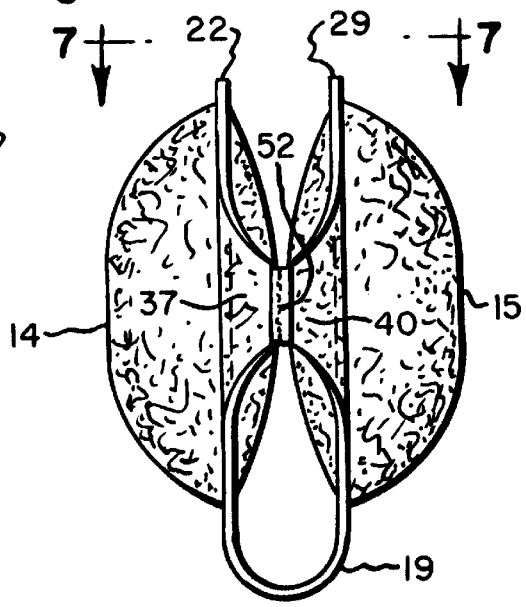
Fig. 8.

Fig. 9.
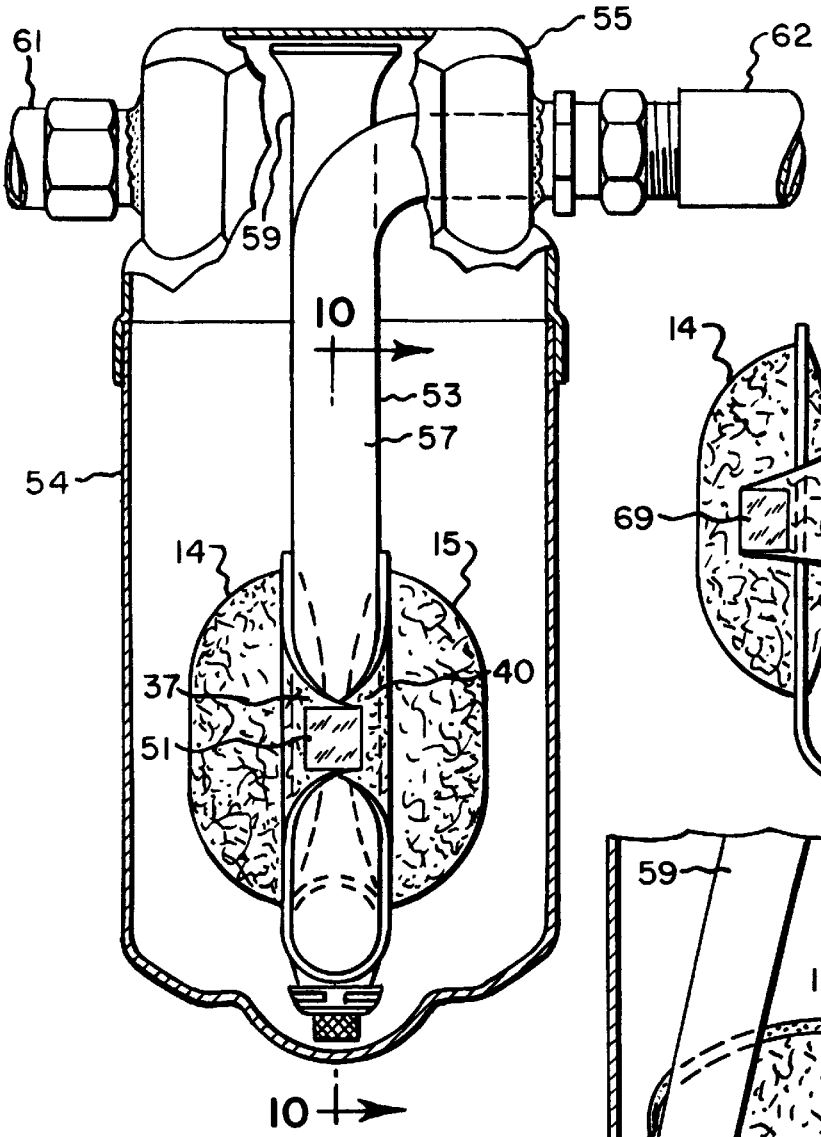
Fig. 12.
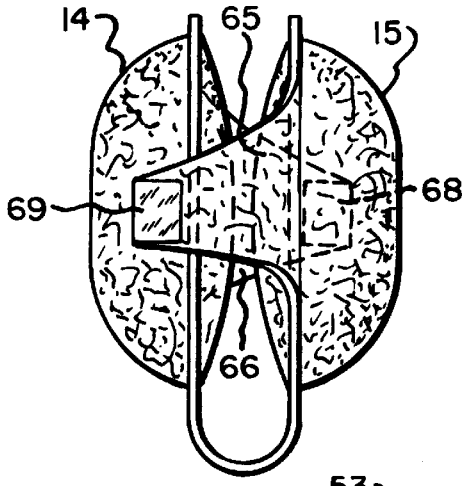
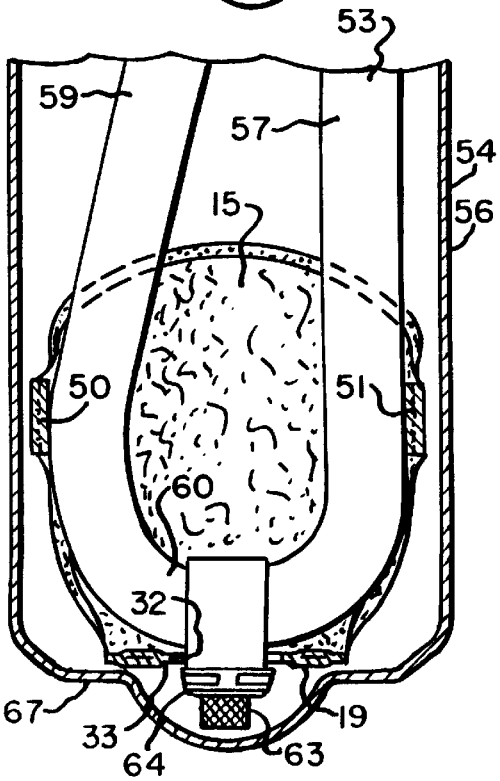
Fig. 10.
Fig. 11.
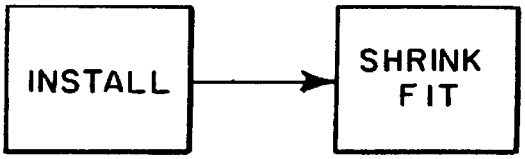

SADDLE-TYPE ADSORBENT UNIT

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention relates to an improved saddle-type adsorbent unit.

By way of background, there are numerous saddle-type adsorbent units known. These units generally include a member which couples two spaced adsorbent containers, and this member is placed underneath the return bend of a U-shaped pipe of a refrigerant accumulator, with the adsorbent containers lying on opposite sides of the U-shaped pipe. In the past a tie member was wound around the adsorbent containers to maintain them against the U-shaped pipe, to thereby stabilize them against movement during the installation of the U-shaped pipe into its associated accumulator housing. Also, in certain instances it was desirable to maintain the adsorbent unit spaced from the side of the accumulator housing. This required additional labor and materials. It is with overcoming the foregoing deficiency of the prior art that the present invention is concerned.

BRIEF SUMMARY OF THE INVENTION

It is an object of the present invention to provide an improved saddle-type adsorbent unit which does not require a tie to maintain its spaced containers in position against the opposite sides of a U-shaped pipe in an accumulator-type receiver.

Another object of the present invention is to provide an improved receiver-type accumulator which incorporates an improved saddle-type adsorbent unit which does not require an external tie to maintain it in position on a U-shaped pipe and away from the side of the accumulator housing.

A further object is to provide an improved method of fabricating and mounting a saddle-type adsorbent unit on a U-shaped pipe of an accumulator-type receiver. Other objects and attendant advantages of the present invention will readily be perceived hereafter.

The present invention relates to an adsorbent unit comprising first and second porous fabric adsorbent containers, adsorbent in said containers, inner and outer end portions on said containers, a connecting member connecting said inner end portions of said containers, first and second side edge portions on said first and second containers, respectively, at least one first tab extending outwardly from at least one of said first and second side edge portions, and at least one second tab extending outwardly from at least one of said first and second side edge portions.

The present invention also relates to an improvement in an accumulator having a housing with a bottom wall and a side wall and a U-shaped pipe with a return bend proximate said bottom wall and with first and second pipe portions extending from said return bend, the improvement consisting of an adsorbent unit comprising first and second porous fabric adsorbent containers, adsorbent in said containers, inner and outer end portions on said containers, a connecting member connecting said inner end portions of said first and second containers, said connecting member being positioned between said return bend and said bottom wall, first and second side edge portions on said first and second containers, respectively, said first and second containers being positioned on opposite sides of said first and second pipe portions, and connecting means connecting at least one of said first side edge portions to an adjacent second side edge portion.

The present invention also relates to a method of fabricating and installing an adsorbent unit on a U-shaped pipe having spaced pipe portions comprising the steps of providing a U-shaped pipe having spaced pipe portions and a return bend joining said spaced pipe portions, fabricating an adsorbent unit having first and second containers having sides and having adsorbent therein and having a connecting member coupling said first and second containers in spaced relationship, said first and second containers having two first and two second side edge portions, respectively, orienting said first and second containers with said first side edge portions adjacent to said second side edge portions and with two of said sides facing each other, connecting at least one of said first side edge portions to at least one of said second side edge portions, and mounting said adsorbent unit on said U-shaped pipe with said first and second containers on the opposite sides of said first and second pipe portions and with said connecting member adjacent said return bend and with said connected first and second side edge portions adjacent one of said spaced pipe portions.

The various aspects of the present invention will be more fully understood when the following portions of the specification are read in conjunction with the accompanying drawings wherein:

BRIEF DESCRIPTION OF THE SEVERAL VIEWS OF THE DRAWING

FIG. 1 is a plan view of the improved adsorbent unit of the present invention;

FIG. 2 is a side elevational view taken substantially in the direction of arrows 2—2 of FIG. 1;

FIG. 3 is an end elevational view taken substantially in the direction of arrows 3—3 of FIG. 1;

FIG. 4 is an end elevational view of the adsorbent unit taken substantially in the direction of arrows 4—4 of FIG. 5 after the sides of the two containers have been connected;

FIG. 5 is a side elevational view taken substantially in the direction of arrows 5—5 of FIG. 4;

FIG. 6 is a fragmentary view of an alternate embodiment of the adsorbent unit of FIG. 1 having a different shaped aperture in the connecting member which connects the adsorbent containers;

FIG. 7 is a fragmentary end elevational view taken substantially in the direction of arrows 7—7 of FIG. 8 and showing an alternate manner of connecting the tabs of the embodiments of FIGS. 1–6;

FIG. 8 is a side elevational view taken substantially in the direction of arrows 8—8 of FIG. 7;

FIG. 9 is a fragmentary cross sectional view of a refrigerant accumulator having the adsorbent unit of FIGS. 1–5 mounted on the U-shaped pipe of the accumulator;

FIG. 10 is a fragmentary cross sectional view taken substantially along line 10—10 of FIG. 9;

FIG. 11 is a flow diagram of a portion of the process of installing the improved adsorbent unit onto the U-shaped pipe;

FIG. 12 is a side elevational view of still another alternate manner of connecting the containers to each other;

DETAILED DESCRIPTION OF THE INVENTION

Figure 13:
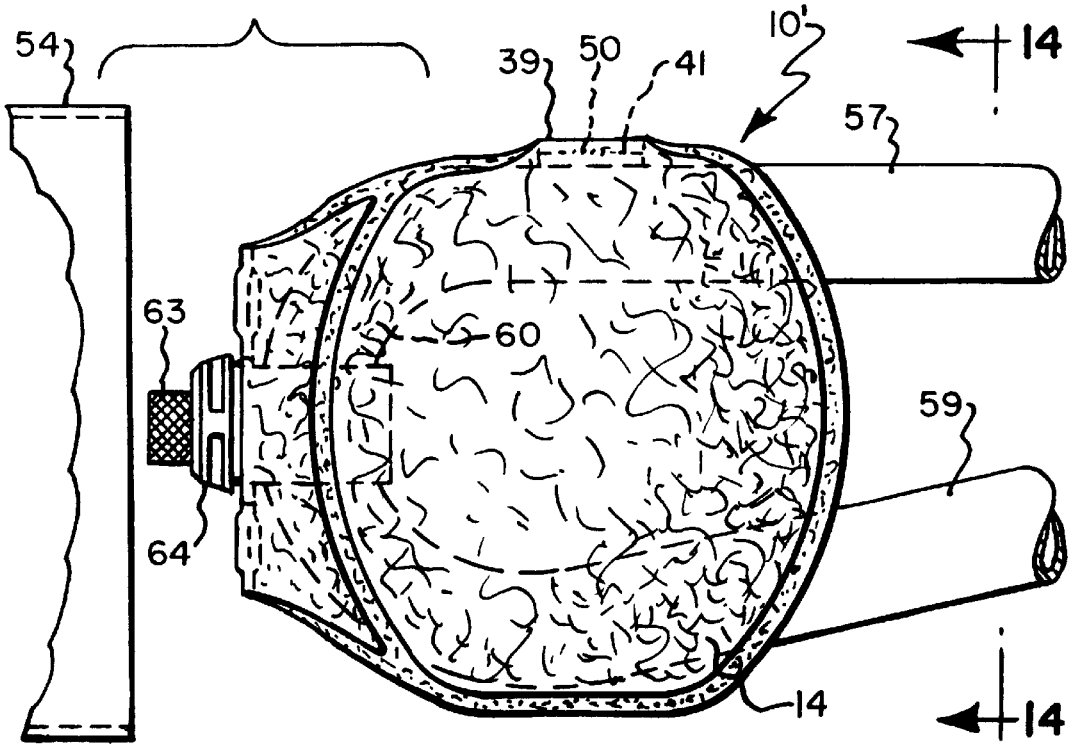
FIG. 13 is a fragmentary side elevational view of a modified adsorbent unit mounted on a U-shaped pipe oriented with one pipe portion above the other pipe portion.

The adsorbent unit 10 of the present invention is formed from two sides or sheets 12 and 13 of felted polyester fabric which are bonded to each other by fused seams, and it comprises two bags or containers 14 and 15 containing adsorbent 17, which in this instance is molecular sieve but can be any other suitable adsorbent. Containers 14 and 15 are connected to each other by a connecting member 19. Container 14 is defined by fused seams 20, 21, 22 and 23. Container 15 is defined by fused seams 24, 25, 27 and 29. The connecting member 19 is defined by fused seams 20, 30, 24 and 31. Connecting member 19 has an aperture 32 therein which is defined by fused seam 33. The connecting member 19 also has fused seams 34 and 35 therein. Containers 14 an 15 have inner and outer end portions. The inner end portions are adjacent fused seams 20 and 24, and the outer end portions are adjacent fused seams 22 and 29.

Tabs 37 and 39 extend laterally outwardly from the side edge portions of container 14, which are at fused seams 21 and 23, respectively. Tabs 40 and 41 extend laterally outwardly from the side edge portions of container 15, which are at fused seams 25 and 27, respectively. Tab 37 is defined by fused seam 42 and fused seam 21. Tab 39 is defined by fused seam 43 and fused seam 23. Tab 40 is defined by fused seam 44 and fused seam 25. Tab 41 is defined by fused seam 45 and fused seam 27.

All portions of adsorbent unit 10 which do not have the fused seams described above, retain their original characteristic of the felted polyester fiber from which the adsorbent unit 10 is fabricated. All of the above-described fused seams are made by the process of ultrasonic welding or they can be made by heat-sealing or they can be made by any suitable process of fusing sides 12 and 13 together. Also sides 12 and 13 can be fastened to each other in any other suitable manner.

In accordance with the present invention, the adsorbent unit 10 is formed into the configuration shown in FIGS. 4 and 5 wherein side 47 of container 14 is positioned in facing relationship to side 49 of container 15. In this position tabs 39 and 41 are fused to each other at 50 and tabs 37 and 40 are fused to each other at 51. The fusing can be by ultrasonic welding, heat-sealing or by any other suitable method.

An alternate way of connecting tabs 37 and 40 and connecting tabs 39 and 41 is shown in FIGS. 7 and 8 wherein a seal 52 is made when the tabs 37 and 40 are lapped in facing relationship, rather than in overlying lapped relationship as shown in FIGS. 4 and 5. An alternate configuration is shown in FIG. 6 for connecting member 19' which connects containers 14 and 15. The only difference between connecting member 19 and connecting member 19' is that the latter has a rectangular aperture 32' which is bonded by fused seams 34 and 35.

The improved adsorbent unit 10, as configured in FIGS. 4 and 5, is mounted on the U-shaped pipe 53 which is positioned within side wall 56 of housing 54 of refrigerant accumulator 55. The U-shaped pipe 53 includes spaced pipe portions 57 and 59 which are connected by a return bend 60 having an aperture (not shown) therein, which is covered by filter 63. As is well known, pipe 61 leads from the evaporator and conducts a mixture of liquid and gaseous refrigerant into housing 54. The gaseous refrigerant enters the opening in the top of pipe portion 59 and flows through U-shaped pipe 53 into conduit 62 leading to the compressor. The accumulator 55 is merely portrayed as being representative of the type of accumulator which has a U-shaped pipe within a housing. It will therefore be appreciated that the adsorbent unit 10 can be mounted in any type of accumulator having a U-shaped pipe within a housing.

The adsorbent unit 10, as formed in FIGS. 4 and 5, is slipped over the return bend 60 of U-shaped pipe 53, and the filter 63 and its associated collar 64 pass through the aperture 32 (FIGS. 1 and 10) in connecting member 19. It is to be noted that the fused tabs 50 and 51, in the installed position of adsorbent unit 10, are located abreast of the widest portion of the U-shaped pipe proximate the return bend 60. Thus, the adsorbent unit 10 is held against lateral movement because of the substantially contiguous relationship between the fused tabs and the substantially widest spacing of pipe portions 57 and 59 at the return bend 60. Additionally, the collar 64 will tend to prevent the adsorbent unit 10 from dropping downwardly, considering that the inner edges of fused rim 33 can catch on collar 64. If desired, an oversized collar, which is larger than aperture 32, may be mounted at collar 64 to further retain the connecting member 19 in position. Also the connecting member 19 is positioned between U-bend 60 and the bottom wall 67 of the housing 64.

After the adsorbent unit 10 has been mounted on the U-shaped pipe, but before the U-shaped pipe is installed into housing 54, the adsorbent unit mounted on the U-shaped pipe 53 can be passed through a heating chamber at about 250° F. for the proper time period to effect the combined function of essentially singeing the surface of the adsorbent unit 10 to prevent shedding of the felted polyester fibers and additionally shrink-fitting the adsorbent unit 10 onto U-shaped pipe 53. The heating will distort and shrink the rim 33 of aperture 32 to thereby tend to prevent connecting member 19 from being dislodged from its installed position.

While the above description has disclosed the preferred method of connecting the tabs to each other by a fusion process, it will be understood that other ways of connecting the adsorbent containers 14 and 15 in the orientation of FIGS. 4 and 5 are within the scope of the present invention. Alternate methods may include, without limitation, utilizing snaps to attach the tabs, or sewing the tabs, or stapling the tabs, or gluing the tabs, or fastening them to each other in any suitable manner so that the adsorbent unit will retain the configurations shown in FIGS. 4 and 5.

Additionally, as shown in FIG. 12, only a single elongated tab 65 may extend from one side edge portion of container 15 and be fused or otherwise suitably attached to container 14 at 69, and a single elongated tab 66 may extend from the side edge portion of container 15 and be fused or otherwise suitably attached to container 15 at 68. Also a single elongated tab such as 65 can extend from both sides of either container 14 or 15, and the other ends of such tabs may be fused or otherwise suitably attached to the side wall of the adjacent container when the containers 14 and 15 are oriented in the positions shown in FIGS. 4 and 5. Also, the tabs which connect the containers 14 and 15 to each other may be separate members which are suitably connected to the side walls of each of the containers.

Figure 14:
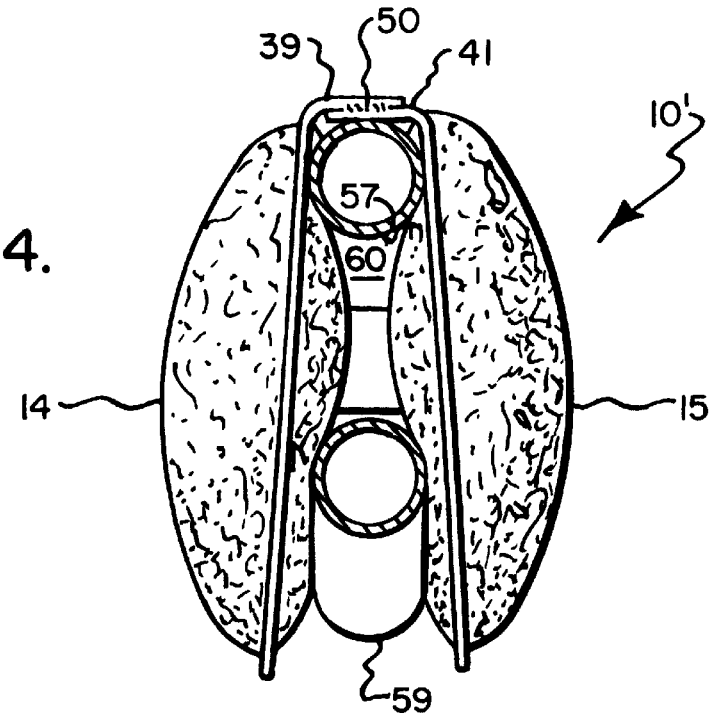
FIG. 14 is a cross sectional view taken substantially along line 14—14 of FIG. 13.

All of the above embodiments have shown the two side edge portions of each of the containers 14 and 15 connected to each other. However, it is possible to connect only one side edge portion of one container to an adjacent side edge portion of the other container while leaving the other two side edge portions unconnected. An adsorbent unit 10' of this type is shown in FIGS. 13 and 14. All parts of adsorbent unit 10' are identical in all respects to corresponding parts of the adsorbent unit 10 of FIGS. 1–5, and like numerals represent identical elements of structure. The only difference between adsorbent unit 10 and adsorbent unit 10' is that in unit 10' tabs such as 39 and 41 are located only on one side of each of the containers 14 and 15, as shown in FIG. 14. The tab or tabs which connect only two of the side edge portions may be any of the tabs such as described above relative to FIGS. 1–5 and FIG. 12 or a separate tab connected to each container. An embodiment of the type shown in FIGS. 13 and 14 can be installed on a horizontally oriented U-shaped pipe 53 having the pipe portions 57 and 59 oriented one above the other. The installation into housing 54 is effected by resting the joined tabs 39 and 41 on the horizontally oriented upper pipe portion 57 of the U-shaped pipe in the position shown in FIG. 13, and thereafter slipping the foregoing assembly into a horizontally disposed accumulator housing 54.

Additionally, the tabs, such as 37, 39, 40 and 41 of FIG. 1, or the tabs 65 of FIG. 12, need not be of the configurations shown, but they may be of any other suitable configuration which permits them to be fastened in the manners described above.

While preferred embodiments of the present invention have been disclosed, it will be appreciated that it is not limited thereto but may be otherwise embodied within the scope of the following claims.

We claim:

1. An adsorbent unit comprising first and second porous fabric adsorbent containers, adsorbent in said containers, inner and outer end portions on said containers, a connecting member connecting said inner end portions of said containers, first and second side edge portions on said first and second containers, respectively, at least one first tab extending outwardly from at least one of said first and second side edge portions, and at least one second tab extending outwardly from at least one of said first and second side edge portions.

2. An adsorbent unit as set forth in claim 1 wherein said first and second containers include first and second sides, respectively, and wherein one of said first sides is positioned in facing relationship to one of said second sides, and wherein said at least one first tab is connected to said at least one second tab.

3. An adsorbent unit as set forth in claim 2 wherein said at least one first tab is connected to said at least one second tab in an overlying lapped relationship.

4. An adsorbent unit as set forth in claim 3 wherein said at least one first tab is bonded to said at least one second tab.

5. An adsorbent unit as set forth in claim 1 including first tabs extending outwardly from all of said first side edge portions, and second tabs extending outwardly from all of said second side edge portions.

6. An adsorbent unit as set forth in claim 5 wherein said first and second containers include first and second sides, respectively, and wherein one of said first sides is positioned in facing relationship to one of said second sides, and wherein said first tabs are connected to said second tabs.

7. An adsorbent unit as set forth in claim 6 wherein said first tabs are connected to said second tabs in overlying lapped relationships.

8. An adsorbent unit as set forth in claim 7 wherein said first tabs are bonded to said second tabs.

9. An adsorbent unit as set forth in claim 1 wherein said at least one of said first and second tabs which extends outwardly from one of said first and second side edge portions of said first and second containers is connected to the other of said first and second containers.

10. An adsorbent unit as set forth in claim 1 wherein a first single tab extends outwardly from one of said first side edge portions and is connected to the other of said containers, and wherein a second single tab extends outwardly from one of said second side edge portions and is connected to the other of said containers.

11. In an accumulator having a housing with a bottom wall and a side wall and a U-shaped pipe with a return bend proximate said bottom wall and with first and second pipe portions extending from said return bend, the improvement of an adsorbent unit comprising first and second porous fabric adsorbent containers, adsorbent in said containers, inner and outer end portions on said containers, a connecting member connecting said inner end portions of said first and second containers, said connecting member being positioned between said return bend and said bottom wall, first and second side edge portions on said first and second containers, respectively, a first tab extending outwardly from at least one of said first and second side edge portions, a second tab extending outwardly from at least one of said first and second side edge portions, said first and second containers being positioned on opposite sides of said first and second pipe portions, and at least one of said first and second tabs being connected to each other and located to the side of one of said first and second pipe portions.

12. In an accumulator as set forth in claim 11 wherein said first tab is connected to said second tab in an overlying lapped relationship.

13. In an accumulator as set forth in claim 12 wherein said first tab is bonded to said second tab.

14. In an accumulator as set forth in claim 11 including first tabs extending outwardly from all of said first side edge portions, second tabs extending outwardly from all of said second side edge portions, and wherein said first tabs are connected to said second tabs and are located adjacent to said first and second pipe portions.

15. In an accumulator as set forth in claim 14 wherein said first tabs are connected to said second tabs in an overlying lapped relationship.

16. In an accumulator as set forth in claim 15 wherein said first tabs are bonded to said second tabs.

17. In an accumulator as set forth in claim 11 wherein said return bend includes a filter extending toward said bottom wall, and wherein said connecting member includes an aperture, and wherein said filter extends through said aperture.

18. In an accumulator as set forth in claim 17 wherein said first tab is connected to said second tab in an overlying lapped relationship.

19. In an accumulator as set forth in claim 18 wherein said first tab is bonded to said second tab.

20. In an accumulator as set forth in claim 17 including first tabs extending outwardly from all of said first side edge portions, second tabs extending outwardly from all of said second side edge portions, and wherein said first tabs are connected to said second tabs and are located adjacent to said first and second pipe portions.

21. In an accumulator as set forth in claim 20 wherein said first tabs are connected to said second tabs in an overlying lapped relationship.

22. In an accumulator as set forth in claim 21 wherein said first tabs are bonded to said second tabs.

23. In an accumulator having a housing with a bottom wall and a side wall and a U-shaped pipe with a return bend proximate said bottom wall and with first and second pipe portions extending from said return bend, the improvement of an adsorbent unit comprising first and second porous fabric adsorbent containers, adsorbent in said containers, inner and outer end portions on said containers, a connecting member connecting said inner end portions of said first and second containers, said connecting member being positioned between said return bend and said bottom wall, first and second side edge portions on said first and second containers, respectively, said first and second containers being positioned on opposite sides of said first and second pipe portions, and connecting means connecting at least one of said first side edge portions to an adjacent second side edge portion.

24. In an accumulator as set forth in claim 23 including means connecting all of said first side edge portions to all of said second side edge portions.

25. In an accumulator as set forth in claim 23 wherein said connecting means comprises a single tab connecting one first side edge portion to one second side edge portion.

26. In an accumulator as set forth in claim 23 wherein said connecting means comprises a first single tab connecting one first side edge portion to one second side edge portion, and a second single tab connecting another first side edge portion to another second side edge portion.

27. A method of fabricating and installing an adsorbent unit on a U-shaped pipe having spaced pipe portions comprising the steps of providing a U-shaped pipe having spaced pipe portions and a return bend joining said spaced pipe portions, fabricating an adsorbent unit having first and second containers having sides and having adsorbent therein and having a connecting member coupling said first and second containers in spaced relationship, said first and second containers having two first and two second side edge portions, respectively, orienting said first and second containers with said first side edge portions adjacent to said second side edge portions and with two of said sides facing each other, connecting at least one of said first side edge portions to at least one of said second side edge portions, and mounting said adsorbent unit on said U-shaped pipe with said first and second containers on the opposite sides of said first and second pipe portions and with said connecting member adjacent said return bend and with said connected first and second side edge portions adjacent one of said spaced pipe portions.

28. A method as set forth in claim 27 including the step of connecting both of said first side edge portions to both said second side edge portions.

29. A method as set forth in claim 28 including the step of heating said adsorbent unit to shrink it about said U-shaped pipe.

30. An adsorbent unit comprising first and second porous fabric adsorbent containers, adsorbent in said containers, inner and outer end portions on said containers, a connecting member connecting said inner end portions of said containers, first and second side edge portions on said first and second containers, respectively, and means connecting at least one of said first side edge portions to at least one of said second side edge portions with said containers in side-by-side relationship.

31. An adsorbent unit comprising first and second porous fabric adsorbent containers, adsorbent in said containers, inner and outer end portions on said containers, a connecting member connecting said inner end portions of said containers, first and second side edge portions on said first and second containers, respectively, and means connecting at least one of said first side edge portions to at least one of said second side edge portions with said containers in side-by-side relationship.

32. An adsorbent unit comprising first and second porous fabric adsorbent containers, adsorbent in said containers, inner and outer end portions on said containers, a connecting member connecting said inner end portions of said containers, first and second side edge portions on said first and second containers, respectively, and at least one of said first side edge portions being connected to at least one of said second side edge portions with said containers in side-by-side relationship.

33. An adsorbent unit as set forth in claim 32 wherein both of said first side edge portions are connected to both of said second side edge portions.

34. An adsorbent unit comprising first and second porous fabric adsorbent containers, adsorbent in said containers, inner and outer end portions on said containers, a connecting member connecting said inner end portions of said containers, first and second side edge portions on said first and second containers, respectively, and at least one tab extending outwardly from at least one of said first and second side edge portions.

35. An adsorbent unit as set forth in claim 34 wherein said at least one tab which extends outwardly from at least one of said first and second side edge portions of said first and second containers is connected to the other of said first and second containers.

36. An adsorbent unit as set forth in claim 34 wherein single tabs extend outwardly from both side edge portions of one of said first and second containers and are connected to the other of said first and second containers.

37. An adsorbent unit as set forth in claim 34 wherein a first single tab extends outwardly from one of said first side edge portions and is connected to said second container, and wherein a second single tab extends outwardly from one of said second side edge portions and is connected to said first container.

* * * * *

UNITED STATES PATENT AND TRADEMARK OFFICE

CERTIFICATE OF CORRECTION

PATENT NO. : 5,987,915

DATED : November 23, 1999

INVENTOR(S) : Samuel A. Incorvia et al

It is certified that error appears in the above-identified patent and that said Letters Patent is hereby corrected as shown below:

Column 8, lines 13-16 (claim 31), change "means connecting at least one of said first side edge portions to at least one of said second side edge portions with said containers in side-by-side relationship" to --tab means connecting one of said first side edge portions to an adjacent one of said second side edge portions while leaving other of said first and second side edge portions unconnected--.

Signed and Sealed this

Fifteenth Day of August, 2000

*Attest:*

*Attesting Officer*

Q. TODD DICKINSON

*Director of Patents and Trademarks*